US006922541B2

(12) United States Patent
Phillips

(10) Patent No.: US 6,922,541 B2
(45) Date of Patent: Jul. 26, 2005

(54) METHODS AND APPARATUS FOR FUSING AN IMAGING SUBSTANCE ONTO AN IMAGING MEDIA

(75) Inventor: Quintin T. Phillips, Boise, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 46 days.

(21) Appl. No.: 10/464,606

(22) Filed: Jun. 17, 2003

(65) Prior Publication Data

US 2004/0258425 A1 Dec. 23, 2004

(51) Int. Cl.[7] ..... G03G 15/20
(52) U.S. Cl. ..... 399/285; 399/69
(58) Field of Search ..... 399/67, 69, 285; 219/216

(56) References Cited

U.S. PATENT DOCUMENTS 4,920,250 A 4/1990 Urban
5,581,341 A 12/1996 Tanaka
6,087,641 A * 7/2000 Kinouchi et al. ..... 219/619

* cited by examiner

*Primary Examiner*—Quana Grainger

(57) ABSTRACT

Apparatus and methods in accordance with the present invention relate to fusing of images to imaging media. A method in accordance with one embodiment of the present invention includes defining an initial image area on the imaging media, and ascertaining one or more input parameters corresponding to the initial imaging area. The method further includes determining a heater-on period and/or a heater-on frequency as a function of the one or more input parameters, and operating the heater at the heater-on frequency and/or the heater-on period to fuse the initial imaging area.

30 Claims, 5 Drawing Sheets

METHODS AND APPARATUS FOR FUSING AN IMAGING SUBSTANCE ONTO AN IMAGING MEDIA

BACKGROUND

Many various forms of imaging apparatus and methods are known in the art. The term "imaging apparatus and methods" generally refers to devices and processes for forming visual images on image-carrying media ("imaging media"). One of the most widely known forms of imaging apparatus is that commonly known as the "printer." One of the most popular types of printers is that known in the art as the electrophotographic printer, which is also often referred to as a "laser printer."

Laser printers generally function by employing a controlled light source (such as a laser, or light emitting diode) to form a latent version of the desired image on a photoconductive surface. An imaging substance (often in the form of powdered toner) is then applied to the latent image. The imaging substance generally adheres only to the latent image portion of the photoconductive surface, thus forming a visual image. The imaging substance is then ultimately transferred to the imaging media that is most often in the form of paper sheet.

A fuser, or fusing device, is often included in the laser printer. The function of the fusing device is to thermally affix, or fuse, the imaging substance to the imaging media, especially in cases wherein the imaging substance is in the form of powdered toner. The fusing device typically includes a heater configured to heat at least a portion of the fusing device. The heat energy produced by the heater within the fusing device is employed to heat the imaging substance and/or the imaging media so as to form a bond between the imaging substance and the imaging media.

The temperature to which the imaging substance and/or the imaging media are heated is often relatively critical with respect to the quality of the bond between the imaging substance and the imaging media. Thus, the temperature of the heater can be substantially critical with respect to the final image product. The temperature to which the imaging substance and/or imaging media is heated by the fusing device and/or heater can be affected by various environmental variables such as ambient temperature, ambient humidity, media caliper (thickness), and/or several other variables.

Typically, the heater of conventional fusing devices is configured to operate between two predetermined, fixed temperature set points. That is, the fusing device heater is typically configured to operate between an upper temperature set point and a lower temperature set point, between which is an operational temperature range. The upper and lower temperature set points are generally chosen with the goal of enabling the fuser to produce adequate image fusing results under a broad range of environmental conditions and other operational parameters.

Conventional fusing devices also generally include a temperature sensor that is configured to detect the operating temperature of a given portion of the fusing device. Typical fusing devices are configured such that the heater turns on at full power when the sensor detects a fusing device temperature that is below the lower temperature set point. Similarly, typical fusing devices are also configured such that the heater turns completely off when the sensor detects a fusing device temperature that is above the upper temperature set point. In this manner, conventional fusing devices operate over a predetermined temperature range in order to fuse images.

A problem often associated with the aforementioned fuser operational scheme is a phenomenon known as "gloss band." This phenomenon is manifested as distinctly noticeable variations in the level of toner gloss of a solid image such as a photograph or the like. This gloss band phenomenon can be caused by the typically wide operating temperature ranges of conventional fusing device heaters. The gloss band phenomenon can be especially apparent in cases wherein the heater is turned on or turned off while the solid image is being fused.

In other words, the cause of the gloss band phenomenon can often be the significant change in temperature of the fuser due to the fuser heater being turned on or turned off while cycling between the upper and lower temperature set points during fusing of the image. Developments have been made in the prior art to deal with the phenomenon of gloss band with varying degrees of success. However, such developments often have various negative aspects associated therewith.

Therefore, it can be desirable to provide means for controlling a fusing device so as to lessen the effects of the gloss band phenomenon in an imaging device, wherein such means achieve the benefits to be derived from similar prior art apparatus and methods, but which avoid the shortcomings and detriments individually associated therewith.

SUMMARY

In accordance with various embodiments of the present invention, fusing apparatus and methods of operating an imaging fuser are disclosed. A fusing apparatus in accordance with one embodiment of the present invention includes a heater, a processor, a controller adapted to control the heater, a sensor adapted to ascertain an input parameter, and a set of computer executable instructions that are executable by the processor. The heater can be turned on and off, or pulsed, at a heater-on frequency, wherein each time the heater is turned on it remains on for the duration of a heater-on period. The heater-on frequency and/or the heater-on period can be determined by the set of computer executable instructions as a function of the input parameter.

A method in accordance with another embodiment of the present invention includes the steps of defining an initial image area on the imaging media, ascertaining one or more input parameters corresponding to the initial imaging area, determining either a heater-on frequency or a heater-on period as a function of the one or more input parameters, and operating the heater to fuse the initial imaging area at the heater-on frequency and/or the heater-on period.

DETAILED DESCRIPTION

The present invention generally includes apparatus and methods relating to thermal fusing of images. More specifically, an apparatus in accordance with one embodiment of the present invention includes a fuser heater that is adapted to be turned on and off, or pulsed, at a heater-on frequency and/or a heater-on period that can be determined as functions of one or more various input parameters. The heater-on frequency and/or the heater-on period can be determined so as to operate the fuser heater at a relatively stable and accurate temperature under various operational conditions as compared to conventional fusing apparatus employing similar hardware and/or components.

Moreover, once an initial estimate of the heater-on frequency and/or the heater-on period are determined and the fuser is operated in accordance therewith, the fuser temperature can be monitored, and the heater-on frequency and/or heater-on period can be adjusted, or refined, as required in order to stabilize the fuser temperature. Methods in accordance with various embodiments of the present invention include steps of operating an imaging fuser in manners consistent with the configuration of the apparatus described above.

Figure 1:
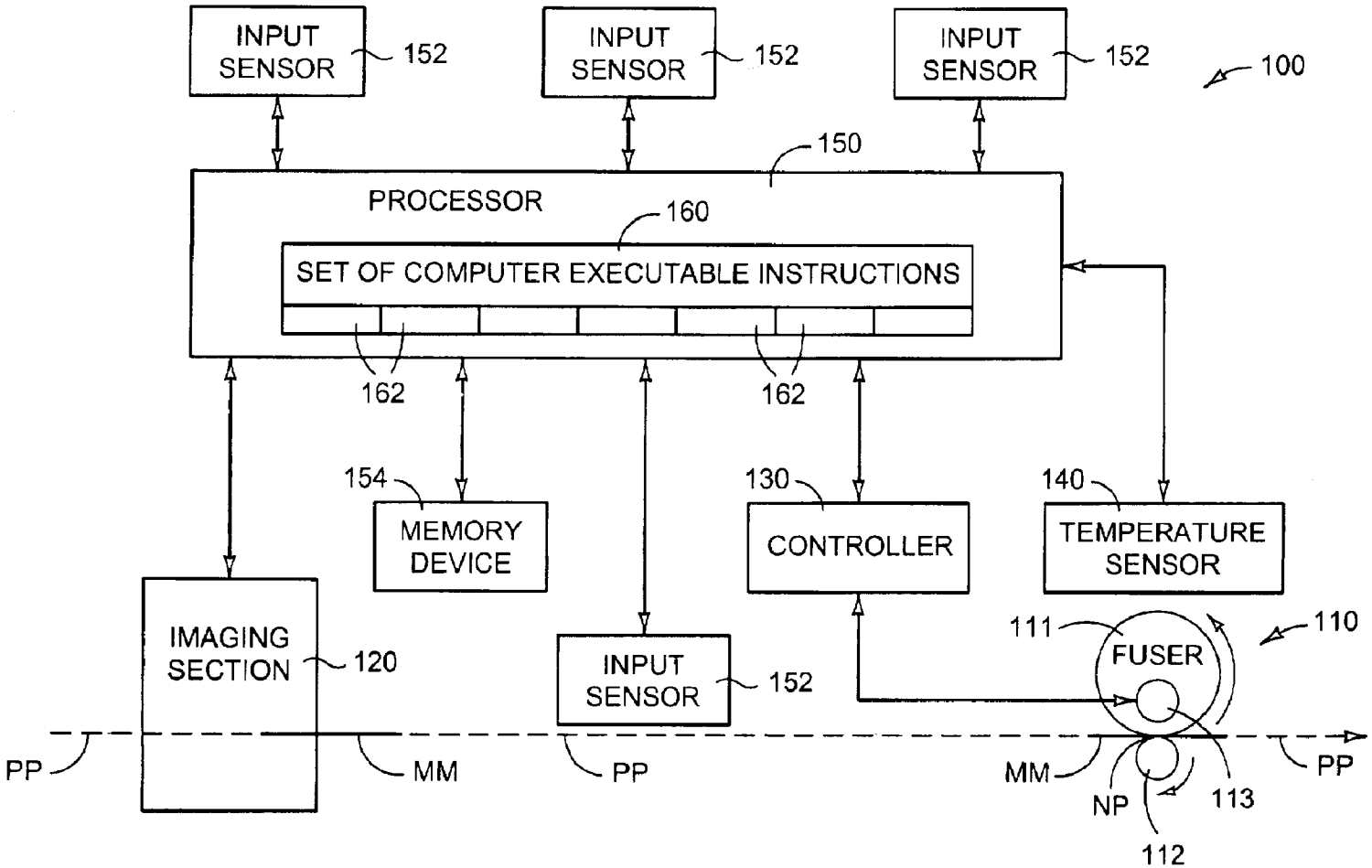
FIG. 1 is a schematic diagram that depicts a fusing apparatus in accordance with one embodiment of the present invention.

Turning now to FIG. 1, a schematic diagram is shown in which a fusing apparatus 100 is depicted in accordance with one embodiment of the present invention. The fusing apparatus 100 is generally configured to thermally fuse an imaging substance (not shown) in the form of a visual image onto an imaging media "MM", such as a sheet of paper or the like. Such thermal fusing processes with regard to imaging substances and imaging media is well known in the art.

The fusing apparatus 100 can include a fuser 110. The fuser 110 can, in turn, include a circulatable contact element roller 111 as well as a pressure roller 112. The fuser roller 111 can have any of a number of specific forms and/or configurations such as, for example, a circulatable contact element as in many conventional fusers. The fuser 110 can also include a heater 113 that is configured to produce heat energy for thermally fusing the imaging substance to the imaging media MM. That is, the heater 113 is configured to produce heat energy that is then to be transferred to the imaging media MM, and/or the imaging substance, so as to thermally fuse the imaging substance to the imaging media, thus forming a bond therebetween.

The heater 113 can include, for example, a heating element (not shown) or the like. Heaters and heating elements and their use in fusing processes are known in the art. Furthermore, as is depicted, the heater 113 can be located within, or inside, the fuser roller 111. In this manner, the heat energy produced by the heater 113 can be substantially transmitted to the imaging media MM, and/or the imaging substance, by way of the fuser roller 111. That is, the heat energy from the heater 113 can pass through the fuser roller 111 in accordance with the thermal image fusing process. Additionally, the pressure roller 112 can be heated by, or receive heat energy from, the heater 113.

As is further depicted in FIG. 1, the fuser roller 111 and the pressure roller 112 can contact one another, and can counter-rotate relative to one another in the directions indicated, so as to form a nip point "NP" therebetween. The nip point NP can be located on a media path "PP" which can be defined by any of a number of known imaging media conveyance and handling devices and means such as, for example, rollers, guides, and the like (not shown).

That, is, the apparatus 100 can include the media path PP that can be configured to convey one or more sheets of imaging media MM therealong and through the fuser 110. Media paths such as the media path PP are known in the art, as are the various components and devices (e.g. rollers, guides) which can be employed to define such media paths.

As is also seen from a study of FIG. 1, the media path PP can be configured to convey one or more sheets of imaging media MM through an imaging section 120 that can be located upstream of the fuser 110. The imaging section 120 can be configured to produce images from an imaging substance and to deposit the imaging substance in the form of an image onto each of the sheets of imaging media MM that are conveyed through the imaging section and along the media path PP.

Once the imaging substance is deposited on a given sheet of imaging media MM at the imaging section 120 as described above, the given sheet of imaging media can then be conveyed along the media path PP from the imaging section to the fuser 110 where the imaging substance can be thermally fused, or affixed, to the imaging media. Furthermore, after passing through the fuser 110, the given sheet of imaging media MM can be further conveyed along the media path PP in the direction indicated to be ultimately deposited, for example, into an output tray (not shown), or the like.

The apparatus 100 can also include a processor 150. The processor 150 can have any of a number of known forms including a programmable logic computer, a processor "chip," and the like. The processor 150 is configured to perform computations and/or to make decisions based thereupon. The processor can also be configured to transmit and/or receive various signals such as, for example, data signals as is discussed further below.

The apparatus 100 can also include a computer-readable memory device 154 that is adapted to store data therein, which data is retrievable by the processor 150. Computer-readable memory devices are known in the art, and frequently comprise semiconductor ROM and/or RAM memory. As is depicted, the processor 150 can be in data-communicative linkage with the memory device 154 as well as one or more additional devices, some of which are described below. The term "data-communicative linkage" as used herein with respect to two or more devices refers to the capability of transmitting data signals to and/or from one such device to another. Many various means of achieving data-communicative linkage between two or more devices are known in the art.

The apparatus 100 can include a set of computer executable instructions 160 which are described in greater detail below. The set of computer executable instructions 160 can include a plurality of individual computer executable steps 162. The set of computer executable instructions are operatively executable by the processor 150 and can be stored in the memory device 154.

As is further shown in FIG. 1, the processor 150 can be in data-communicative linkage with the imaging section 120 if so included in the apparatus 100. Furthermore, the processor 150 can be configured to perform controlling functions with regard to the imaging process to be performed by the imaging section 120. In other words, for example, the processor 150 can be configured to control various functions in connection with the operation of the imaging section 120 as well as other components. Regardless of the degree to which the processor 150 is configured to control the operation of the imaging section 120, or any other component, the set of computer executable instructions 160 can be operatively resident within the memory device 154 and executable by the processor.

Still referring to FIG. 1, the set of computer executable instructions 160 is configured to enable the processor 150 to control the operation of the heater 113 for fusing of imaging substance (not shown) to the imaging media MM. For example, the set of computer executable instructions 160 can be adapted to control the operation of the heater 113 in accordance with one or more various methods of fusing imaging substance to an imaging media such as the imaging media MM, wherein such methods are in accordance with one or more embodiments of the present invention, and which are described in greater detail below.

The apparatus 100 can include one or more input sensors 152, each of which can be connected in data-communicative linkage with the processor 150. Each input sensor 152 can be adapted to detect and/or ascertain one or more various input parameters. The input sensor 152 can also be configured to transmit a data signal to the processor 150, wherein the data signal is indicative of the one or more input parameters detected and/or ascertained by the input sensor. The term "input parameter" as used herein is defined as any parameter or data that can have an effect on the operation of the heater 113 and/or the fuser 111.

Thus, the input sensors 152 can each be configured to detect one or more of a number of different input parameters that can have an effect on the operation of the fuser 110 and/or the heater 113. For example, such input parameters detectable by the input sensors 152 can include various environmental parameters such as ambient temperature, ambient relative humidity, altitude, and the like. Such input parameters can also include, for example, various data regarding the imaging media MM, such as media caliper (thickness), media moisture content, and the like.

Furthermore, the input parameters can include various data regarding the image and/or the imaging substance. More specifically, the input parameters can include data indicative of the type of imaging substance (such as type of toner), and/or the image density. The term "image density" refers to the density of coverage by the imaging substance of the imaging media MM.

Still referring to FIG. 1, the apparatus 100 can also include a controller 130. The controller 130 can be connected in data-communicative linkage with the heater 113 so as to control the operation of the heater. Additionally, the processor 150 and the controller 130 can be connected in communicative linkage with one another. That is, the controller 130 can be adapted to alternately turn the heater 113 on and off in response to control signals transmitted by the processor 150 and received by the controller, wherein such control signals are generated by the processor 150 under the control of the set of computer executable instructions 160 as is described in greater detail below.

As is explained in greater detail below, a first control signal and a second control signal can be transmitted by the processor 150, wherein the first control signal, when received by the controller 130 can cause the heater to turn on, while the second control signal, when received by the controller, can cause the heater to turn off. As is also explained below, the processor 150 can be adapted to transmit a plurality of alternating first control signals and second control signals, wherein each first control signal alternates with an associated second control signal.

That is, the term "plurality of alternating first control signals and second control signals" refers to an arrangement of a plurality of first and second control signals, wherein a first control signal is transmitted, and then a second control signal is transmitted, and then a first control signal is transmitted, and so forth, in an alternating manner. The set of computer executable instructions 160 can be adapted to determine the frequency of the transmission of the first control signals as well as the duration between the transmission of each first control signal and the following second control signal, as is discussed in greater detail below.

The apparatus 100 can additionally include a temperature sensor 140. The temperature sensor 140 can be adapted to detect the temperature of at least a portion of the fuser 111. For example, the temperature sensor 140 can be adapted to detect and/or measure the temperature of the heater 113 and or the temperature of the fuser roller 111, and the like.

The temperature sensor 140 can be further configured to generate a fuser temperature data signal in response to detecting and/or measuring the temperature of at least a portion of the fuser 111. The fuser temperature sensor 140 can also be adapted to transmit the fuser temperature data signal to the processor 150. Such fuser temperature data signals can be transmitted as often as required to fit the operational scheme of the fuser 110.

It is understood that the apparatus 100 can include any number of additional elements and/or devices that are not shown. For example, the apparatus 100 can include a chassis (not shown) on which any of the aforementioned components can be supported. Furthermore, an enclosure (not shown) can be provided to enclose one or more of the aforementioned devices. It is further understood that up to and including all of the aforementioned devices and components can be combined and/or incorporated into a single unitary apparatus. Alternatively, the aforementioned devices and/or components can be arranged into two or more separate interactive components.

As mentioned briefly above, the set of computer executable instructions 160 can be adapted to generate control signals to cause the heater 113 to be switched on and switched off in accordance with at least one fuser control method or operational scheme. That is, the set of computer executable instructions 160 can be adapted to cause the processor 150 to selectively transmit a plurality of first control signals as well as a plurality of second control signals to the controller 130.

The first control signals can be defined as causing the controller 130 to turn the heater 113 on, as is mentioned above. Conversely, the second control signals can be defined as causing the controller 130 to turn the heater 113 off. That is, the transmission of a first control signal from the processor 150 to the controller 130 can cause the controller to turn the heater 113 on, while the transmission of a second control signal from the processor to the controller can cause the controller to turn the heater off. Control signals, in general, as well as the generation, transmission, and use thereof are well understood in the art.

The set of computer executable instructions 160 can be adapted to generate the first and second control signals in any of a number of specific manners. For example, the set of computer executable instructions 160 can be adapted to generate, or cause the transmission of, the first and second control signals in a manner such that the first and second control signals are transmitted at a predetermined frequency.

The predetermined frequency can be fixed. That is, the set of computer executable instructions 160 can be adapted to generate the first control signals at a given frequency and to generate the second control signals at the same given frequency, wherein each second control signal follows the preceding first control signal be a given duration, or period, of time. In this manner, the heater 113 will be turned on at the given frequency and will also be turned off at the given frequency. Also, each time the heater 113 is turned on, it can remain on for a given duration, or period, of time.

For example, the set of computer executable instructions 160 can be adapted to cause the first control signal to be transmitted at a frequency of 2 Hz, wherein two first control signals are transmitted per second. Likewise, the set of computer executable instructions can be adapted to cause the second control signal to be transmitted at a frequency of 2 Hz, wherein the each second control signal lags behind the previous first control signal by a given duration, or period, of time.

In such an example, the heater 113 would be turned on twice per second and would also be turned off twice per second. This frequency of the first control signal can be referred to as the "heater-on frequency" because it is the frequency at which the heater is turned on. Moreover, the heater 113 would remain on for a given time period following the transmission of each first control signal. That is, the heater 113, in such an example, would be on for two distinct periods for each second of time.

Thus, the amount of time that the heater 113 remains on once it is turned on can be referred to as the "heater-on period." The heater-on period can be any length of time that is less than or equal to the inverse, or reciprocal, of the heater-on frequency. For example, if the heater-on frequency is 2 Hz, as in the example above, then the maximum heater-on period is one-half of a second. That is, if the heater-on period is set at the maximum, then the heater 113 will remain on substantially continuously. On the other hand, if the heater-on period is set at less then the maximum, then the heater 113 will be turned on and off at a substantially constant frequency.

Figure 2:
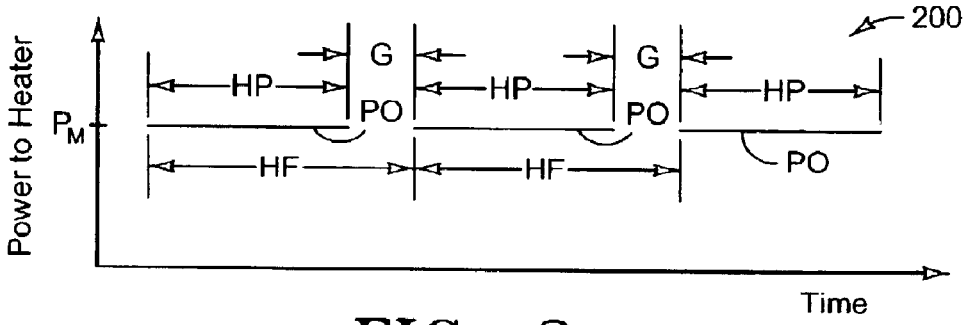
FIG. 2 is a time diagram that depicts one operational scheme for turning the heater of the apparatus of FIG. 1 on and off.

Turning now to FIG. 2, a time diagram 200 is shown in which an example of a fuser operational scheme is depicted in accordance with one embodiment of the present invention. As is seen in the time diagram 200, elapsed time is represented by the horizontal axis, which is labeled "Time." Similarly, the level of power applied to the heater 113 (shown in FIG. 1) is represented by the vertical axis, which is labeled "Power To Heater."

The maximum power capacity of the heater 113 is indicated by the mark on the vertical axis, which mark is labeled "$P_m$" (maximum power). It is understood that the term "power to heater" refers to operational power supplied to the heater to produce heat for accomplishing a thermal fusing operation. The power supplied to the heater can be, for example, electrical power.

Also shown in the time diagram 200 is a plurality of line segments each labeled "PO." The line segments PO represent when the power to the heater 113 is on. That is, the nature of the line segments PO represent how power is applied to the heater 113. More specifically, each of the line segments PO is at a vertical level equal to the maximum power capacity $P_m$ of the heater 113. Furthermore, each of the line segments PO is substantially flat and level. This indicates that the power applied to the heater 113 can be substantially constant and substantially equal to the maximum power capacity of the heater.

It is also seen from a study of FIG. 2 that each line segment PO has a length of "HP". That is, the length HP is a period of time that the heater 113 is on at the power level $P_m$. Accordingly, from the discussion above in view of the time diagram 200, it is understood that each length HP represents a respective heater-on period. Thus, it is seen that FIG. 2 represents a series of heater-on periods each having a duration of HP, wherein the heater 113 is switched on, and remains on for a duration equivalent to the length of the line segment HP, and then is switched off.

A respective space, or gap, G between each line segment PO represents a period of time that the heater 113 is off between heater-on periods HP. Also, a length of time represented by the length HF is shown which represents the duration between the commencement of a given heater-on period HP and the commencement of a subsequent heater-on period. The length of time HF can thus be described as the inverse of the heater-on frequency.

That is, the reciprocal or inverse of the length HF is equal to the frequency at which the heater 113 is turned on, otherwise defined as the heater-on frequency. It is further seen from a study of FIG. 2 that the duration of a given heater-on period HP plus the duration of the respective gap G is equal to the respective length HF, which is equal to the inverse of the heater-on frequency.

As is explained above, the set of computer executable instructions 160 (shown in FIG. 1) can be adapted to cause the processor 150 to transmit a plurality of first control signals and a plurality of second control signals, wherein each of the first control signals causes the heater 113 to be turned on, and wherein each of the second control signals causes the heater 113 to be turned off. Furthermore, each first control signal is transmitted alternately with a respective second control signal.

Thus, with reference to FIG. 2, a given first control signal is transmitted at the beginning of each line segment PO and a subsequent given second control signal is transmitted at the end of each line segment PO, wherein the elapsed time between transmission of the given first control signal and transmission of the given second control signal is equivalent to the length HP. Likewise, the elapsed time between transmission of a given second control signal and transmission of a subsequent first control signal is equivalent to the length G.

Moreover, the frequency at which the first control signals are transmitted is equal to the inverse of the length HF. The inverse of the length HF is also the frequency at which the second control signals are transmitted, wherein transmission of each second control signal lags the transmission of the previous first control signal by the respective heater-on period HP.

Additionally, a close study of FIG. 2 reveals that the length of a given heater-on period HP divided by the respective length HF can represent the average level of power that is delivered to the heater 113. That is, for each time period HF which represents the time duration between successive first control signal transmissions, the respective heater-on period HP divided by the time period HF can represent the average level of power supplied to the heater 113 during the time period HF.

Therefore, for a given heater-on frequency (inverse of length HF), the average level of power supplied to the heater 113 can be determined, by the length of the heater-on period HP divided by the length HF. It is understood that the average level of power supplied to the heater 113 can be substantially directly proportional to the fusing temperature. That is, a higher average level of power supplied to the heater 113 can result in a higher average temperature of the heater.

Likewise, a lower average level of power supplied to the heater 113 can result in a lower average temperature of the heater. It is understood that relatively high heater-on frequencies, which correspond to short lengths of HF, can result in lower temperature variation of the heater. As is discussed above, a more constant fuser temperature can improve the overall quality of the thermal fusing process, as can a more accurate fusing temperature.

It can be recalled from discussion above that the optimum fusing temperature, as well as the level of heat loss from the fuser, can be affected by one or more of the various input parameters which are described above. Accordingly, the set of computer executable instructions 160 can be adapted to determine a heater-on period HP, and/or a heater-on frequency, as a function of one or more input parameters.

For example, the heater-on frequency can be fixed at a predetermined level. Thus, for a given heater-on frequency (inverse of length HF), the heater-on period HP can be determined as a function of one or more input parameters that are detected by the one or more input sensors 152 (shown in FIG. 1). That is, the computer executable instructions 160 can be adapted to tailor, or optimize, the heater-on period HP to provide a certain fuser temperature in response to, or as functions of, the values of the input parameters detected by the input sensors 152.

As discussed above, the length of the heater-on period HP can be directly proportional to the average level of power supplied to the heater 113, which in turn can be directly proportional to the fusing temperature under a given set of environmental parameters. Therefore, by determining the length, or duration, of the heater-on period HP, the set of computer executable instructions 160 can be adapted to control the average heat output of the heater 113 and/or the fusing temperature of the fuser 111 (shown in FIG. 1), in response to given values of input parameters.

Figure 3:
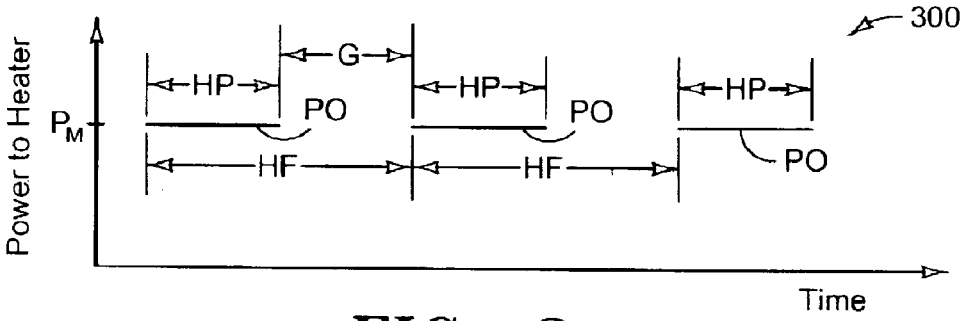
FIG. 3 is another time diagram related to the time diagram of FIG. 2.

An example of how the heater-on period HP can be determined in response to various input parameters can be seen from a study of both FIGS. 2 and 3. FIG. 3 shows a time diagram that is similar to the time diagram 200 shown in FIG. 2. However, as is seen in FIG. 3, the heater-on periods HP of time diagram 300 are shorter relative to those shown in the time diagram 200 shown in FIG. 2. More specifically, the heater-on frequency (inverse of length HF) is substantially the same in both time diagrams 200 and 300. This can represent a fixed, or constant, heater-on frequency.

A close examination of FIGS. 2 and 3 reveals that the heater-on periods HP of the time diagram 200 are approximately three-quarters of the length of the respective distance HF. Thus, for the time diagram 200, the average power supplied to the heater 113 (shown in FIG. 1) is approximately seventy-five percent of maximum power. Comparatively, it is seen that the heater-on periods HP of the time diagram 300 are approximately one-half the respective distance HF. Thus, for the time diagram 300, the average power supplied to the heater 113 is approximately fifty percent of maximum power.

Another way of looking at the time diagrams 200 and 300, shown in FIGS. 2 and 3 respectively, is to observe that the average level of power supplied to the heater 113 in accordance with time diagram 200 is approximately fifty percent greater than the average level of power supplied to the heater in accordance with the time diagram 300. Alternatively, the average level of power supplied to the heater 113 in accordance with the time diagram 300 is approximately thirty-three and one-third percent less than the average level of power supplied to the heater in accordance with the time diagram 200.

It is seen, then, that the set of computer executable instructions 160 (shown in FIG. 1) can be adapted to determine a given duration of the heater-on period HP so as to cause the heater 113 to operate at a desired power level, wherein that desired power level can be determined in response to various input parameters including various environmental conditions and operational parameters and the like such as those specifically discussed above. Moreover, it is seen that the set of computer executable instructions 160 can be adapted to increase or decrease the average level of power supplied to the heater 113 by adjusting the heater-on period.

That is, the set of computer executable instructions 160 can be adapted to control the level of power supplied to the heater 113 by causing each second control signal (which turns the heater 113 off) to be transmitted at the end of a given heater-on period following transmission of each respective first control signal (which turns the heater on), wherein the given heater-on period can be determined by the set of computer executable instructions based on, or as a function of, one or more of the input parameters which can be ascertained by a respective input sensor 152 (shown in FIG. 1).

As an alternative to the above described example, wherein the heater-on frequency is fixed, the following example illustrates that the heater-on frequency can be variable so as to be determined by the set of computer executable instructions 160 in a manner similar to that with regard to the determination of the heater-on period HP, as is described above. Furthermore, the heater-on period HP can be fixed such as in the manner above with regard to the fixed heater-on frequency.

Figure 4:
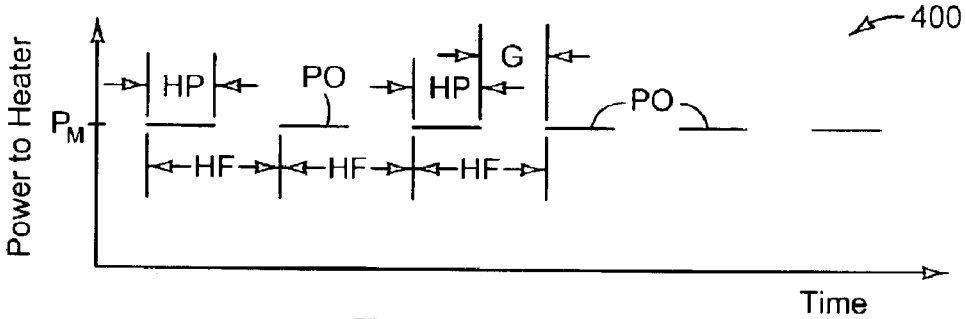
FIG. 4 is another time diagram that depicts another operational scheme for turning the heater of the apparatus of FIG. 1 on and off.
Figure 5:
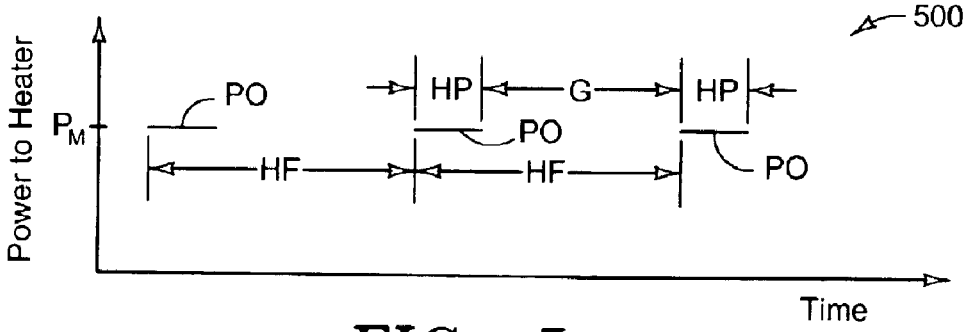
FIG. 5 is another time diagram related to the time diagram of FIG. 4.

More specifically, with reference now to FIGS. 4 and 5, two additional time diagrams 400 and 500 are shown, respectively. Each of the time diagrams 400 and 500 are similar to the time diagrams 200 and 300, which are discussed above with regard to FIGS. 2 and 3, respectively.

However, from a study of the time diagrams 400 and 500 of FIGS. 4 and 5, respectively, it can be seen that the heater-on period HP has substantially the same length, or duration, in each of the time diagrams 400 and 500. That is, the length, or duration, of the heater-on period HP does not vary between the two time diagrams 400 and 500. It is understood that this non-variation of the length, or duration, of the heater-on period HP can illustrate that the heater-on period HP can be fixed.

Further study of time diagrams 400 and 500, of FIGS. 4 and 5 respectively, reveals that the heater-on frequency (inverse of length HF) varies between each of the time diagrams. That is, it is seen from an observation of FIGS. 4 and 5 that the length HF is different in each of the time diagrams 400 and 500. More specifically, it can be seen that the length HF of the time diagram 400 is approximately one-half the length HF of the time diagram 500. That is, the heater-on frequency (inverse of length HF) of the time diagram 400 is approximately twice the heater-on frequency of the time diagram 500.

Thus, because the duration of the heater-on period HP is approximately the same for both time diagrams 400 and 500, and because the heater-on frequency for time diagram 400 is approximately twice the heater-on frequency for time diagram 500, then it can be appreciated that the average power level supplied to the heater 113 in accordance with time diagram 400 is approximately twice the average power level supplied to the heater in accordance with the time diagram 500.

Therefore, it can be appreciated that the set of computer executable instructions 160 (shown in FIG. 1) can be adapted to determine a given heater-on frequency in order to cause the heater 113 to operate at an associated power level in response to various input parameters, including various environmental conditions, and/or various operational parameters and the like such as those specifically discussed above. That is, for example, the set of computer executable instructions 160 can determine the heater-on frequency for a given predetermined heater-on period HP as a function of one or more input parameters.

Thus, it is understood that the set of computer executable instructions 160 can be adapted to cause the transmission of the first control signals and the second control signals, wherein the heater-on period and/or the heater-on frequency is determined as a function of one or more input parameters. That is, for example, the heater-on period HP can be fixed, as is illustrated in FIGS. 4 and 5, wherein the heater-on frequency is variable and determinable by the set of computer executable instructions as a function of one or more input parameters.

Alternatively, for example, the heater-on frequency (inverse of length HF) can be fixed, as is discussed above with reference to FIGS. 2 and 3, wherein the heater-on period HP is variable and determinable by the set of computer executable instructions 160 as a function of one or more input parameters. As yet a further alternative, both the heater-on period HP and the heater-on frequency can be variable and determinable by the set of computer executable instructions 160 as functions of one or more input parameters.

Figure 6:
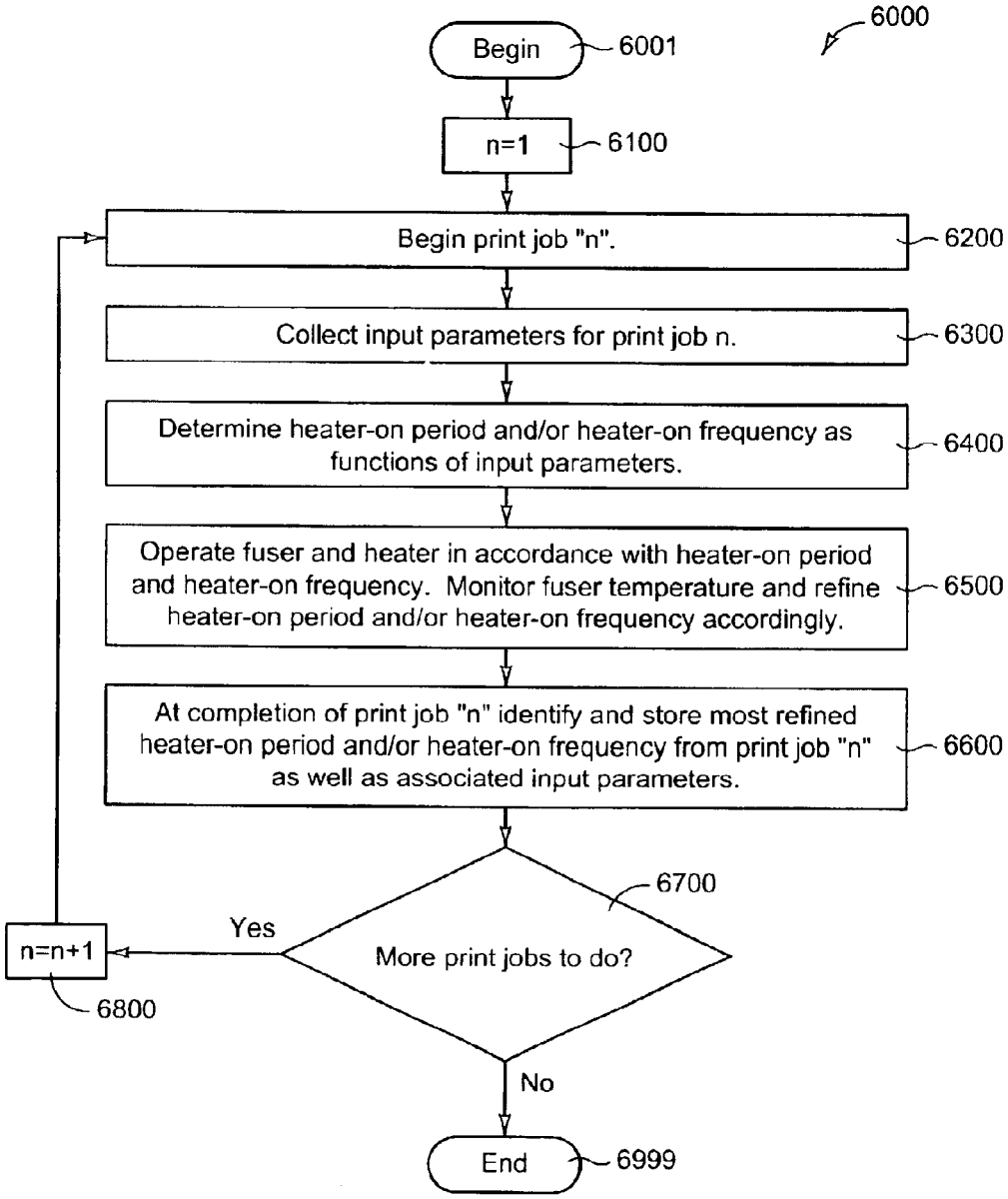
FIG. 6 is a flow diagram that depicts one example of an overall operational scheme that can be employed to control the apparatus of FIG. 1.

Turning now to FIG. 6, a flow diagram 6000 is shown which depicts one possible operational scheme for the apparatus 100 shown in FIG. 1. The flow diagram 6000 begins at 6001 and proceeds to step 6100 in accordance with which a counter is initialized. From step 6100, the flow diagram 6000 moves to step 6200. At step 6200, printing of the "nth" print job is commenced. A print job can be, for example, at least a portion of an image that is to be formed from an imaging substance and deposited on an imaging media such as the imaging media MM (shown in FIG. 1), wherein the imaging substance is to be thermally fused onto the imaging media by way of a fusing device such as the fusing device 110 which is described above with reference to FIG. 1.

The flow diagram 6000 next moves to step 6300, in accordance with which one or more input parameters for the nth print job are ascertained and/or collected. Input parameters are discussed above with reference to FIG. 1, as are the input sensors 152 that can be employed to collect and/or ascertain one or more input parameters.

Moving to step 6400, the heater-on period HP (shown in FIGS. 2 through 5) and/or the heater-on frequency (inverse of length HF, also shown in FIGS. 2 through 5) are determined as functions of the input parameters. For example, step 6400 can be accomplished by the set of computer executable instructions 160 as discussed above with reference to FIGS. 1 through 5. Step 6400 is discussed in greater detail below with reference to additional figures.

Still referring to FIG. 6, the flow diagram 6000 next moves to step 6500 in accordance with which the fuser and/or heater, such as fuser 110 and heater 113 (shown in FIG. 1), are operated at the heater-on period HP and/or heater-on frequency (inverse of length HF) determined in accordance with the previous step of 6400. The step 6500 is also discussed in greater detail below with reference to additional figures.

Furthermore, in accordance with step 6500 the fuser temperature is monitored and the heater-on period (HP, shown in FIGS. 2 through 5) and heater-on frequency (inverse of length HF, also shown in FIGS. 2 through 5) are refined accordingly. It is understood that the term "refined" as used herein is defined as adjusting so as to substantially optimize in accordance with a given set of criteria. It is further understood that any of the flow diagrams discussed herein can be implemented in any of a number of known manners, including that of a lookup table, or that of an algorithm. The process of refining the heater-on period and heater-on frequency is discussed in greater detail below.

With continued reference to FIG. 6, the flow diagram 6000 proceeds next to step 6600, in accordance with which the most refined and/or optimized values for the heater-on period HP and/or the heater-on frequency (inverse of length HF) from the nth print job are stored at the completion of the nth print job, along with the associated input parameters from the nth print job. A memory device such as the memory device 154 discussed above with reference to FIG. 1 can be employed for such storage functions. The step 6600 is also described below in greater detail.

Step 6700, which is the next step in the flow diagram 6000, is a query that asks if there are additional print jobs to process. If the answer to the query of step 6700 is "yes," then the flow diagram 6000 moves to step 6800 in accordance with which the counter is incremented by a value of one. The flow diagram 6000 then returns to step 6200 in accordance with which the next print job is begun. If the answer to the query of step 6700 is "no," then the flow diagram 6000 ends at 6999.

Figure 7:
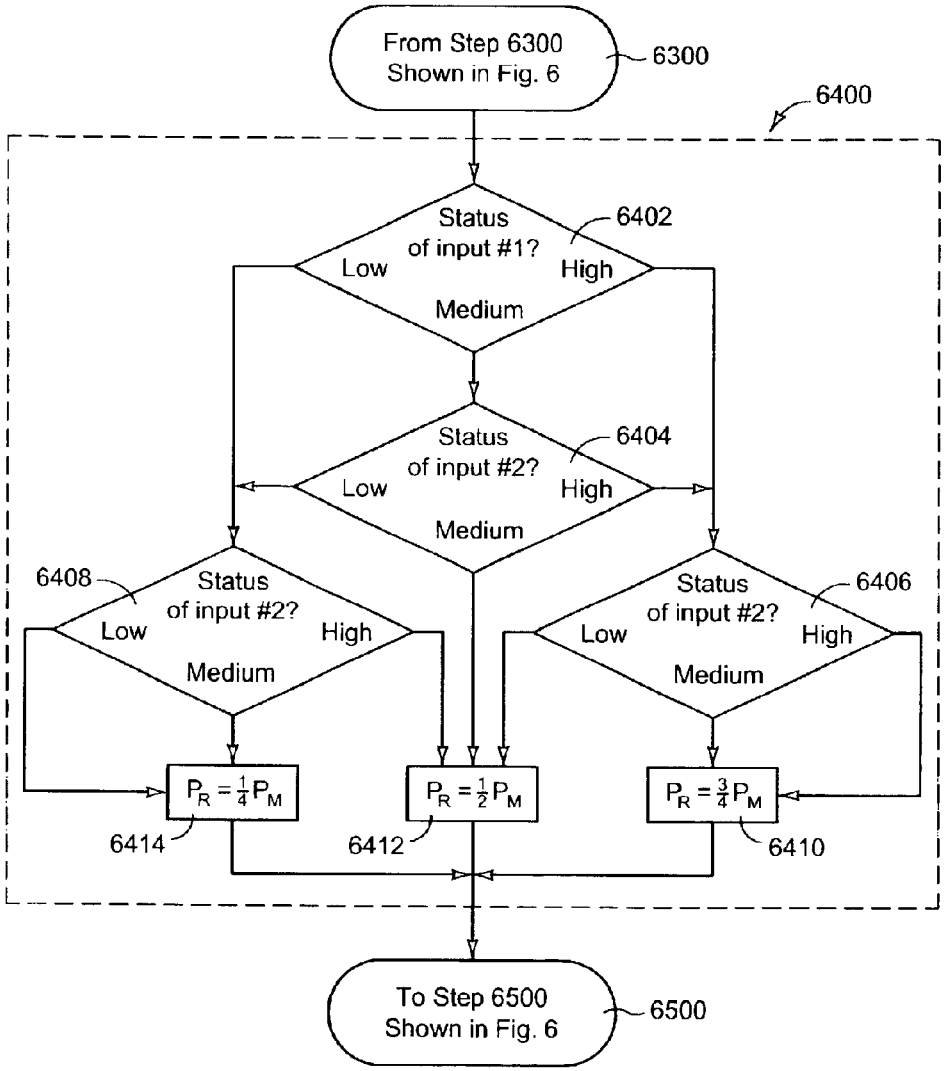
FIG. 7 is another flow diagram that depicts one example of a detailed view of step 6400 of the flow diagram shown in FIG. 6.

Turning now to FIG. 7, another flow diagram is shown which depicts one possible example of a process that can be employed to accomplish at least a portion of step 6400 that is discussed above and shown in FIG. 6. That is, the flow diagram shown in FIG. 7 can be described as depicting a detailed view of step 6400 in accordance with which the heater-on frequency (inverse of length HF, shown in FIGS. 2 through 5) and/or the heater-on period (HP, also shown in FIGS. 2 through 5) are determined. The flow diagram of FIG. 7 can be implemented in any of a number of specific known manners, including that of a lookup table, or that of an algorithm.

It can be recalled from the discussion above that the determinations of the heater-on frequency (inverse of length HF) and/or the heater-on period HP can be made as functions of the input parameters, and that such determinations can affect the average power supplied to the heater 113, and thus can affect the fuser temperature. Thus, the flow diagram of FIG. 7 can also be described as a possible process employed by the apparatus 100 described above with reference to FIG. 1 for determining an estimated power requirement of the heater 113 based on one or more input parameters.

With continued reference to FIG. 7, proceeding from step 6300, step 6402 is a query. The query of step 6402 asks the status of input parameter number one for a given print job or a given image, for instance. Input parameter number one can be, for example, the media caliper, or media thickness. As is seen, input number one can be determined to be low, medium, or high. That is, in this case, the media caliper can be determined through any of a number of various known detection means to be either thin (low), medium, or thick (high).

Thus, if the status of input parameter number one is determined to be low, then the flow diagram of FIG. 7 proceeds to step 6408. Alternatively, if the status of input parameter number one is determined to be medium, then the flow diagram proceeds to step 6404. Finally, if the status of input parameter number one is determined to be high, then the flow diagram of FIG. 7 is directed to step 6406.

As is seen, each of the steps 6404, 6406, and 6408 are also queries. Each of the queries of steps 6404, 6406, and 6408 inquire as to the status of an input parameter number two. Input parameter number two can be another input parameter that is different from input parameter number one. For example, input parameter number 2 can be image density. That is, for example, each of the queries of steps 6404, 6406, and 6408 can ask about the status of the image density of the given print job or given image.

Thus, it can be appreciated from a study of FIG. 7, that if the status of input parameter number one is low and the status of input parameter number two is low, then the flow diagram of FIG. 7 is routed to step 6414. Likewise, if the status of input number one is low and the status of input number two is medium, the flow diagram also ends up at step 6414. Similarly, if the status of input number one is medium and the status of input number two is low, the flow diagram again proceeds to step 6414.

It is also seen that if the status of input parameter number one is low and the status of input parameter number two is high, then the flow diagram of FIG. 7 is directed to step 6412. Likewise, if the status of input parameter number one is medium and the status of input parameter number two is medium, then the flow diagram of FIG. 7 is also directed to step 6412. Alternatively, if the status of input parameter number one is high and the status of input parameter number two is low, the flow diagram again is directed to step 6412.

In a like manner, if the status of input parameter number one is medium and the status of input parameter number two is high, then the flow diagram of FIG. 7 proceeds ultimately to step 6410. Or, if the status of input parameter number one is high and the status of input parameter number two is medium, then the flow diagram also proceeds to step 6410. Lastly, if the status of both input parameter number one and input parameter number two are high, the flow diagram is routed to step 6410.

It is understood that each of the steps 6410, 6412, and 6414 produce operational data. Specifically, each of the steps 6410, 6412, and 6414 contain a given estimated power requirement for the heater 113 that are chosen based on various input parameters as is discussed above. That is, in accordance with step 6410, the estimated power requirement for the heater 113 is three-quarters of maximum power capacity of the heater. Similarly, the estimated power requirement in accordance with step 6412 is one-half of the maximum power capacity of the heater. Also, in accordance with step 6414, the estimated power requirement of the heater 113 is one-quarter of the maximum power capacity.

From each of the steps 6410, 6412, and 6414, the flow diagram of FIG. 7 proceeds to step 6500 which is discussed above with reference to FIG. 6. It can be recalled from the above discussion that in accordance with step 6500, the fuser 110 and/or heater 113 are operated in accordance with the heater-on period HP and/or the heater-on frequency (inverse of length HF) determined in accordance with step 6400. It can also be recalled that the power supplied to the heater 113 can be determined by the duration of the heater-on period HP and/or the heater-on frequency (inverse of length HF), as is discussed above with particular reference to FIGS. 2 through 5.

That is, the estimated power requirement determined in accordance with the flow diagram shown in FIG. 7 can be used, in turn, to determine the duration of the heater-on period HP and/or the heater-on frequency (inverse of length HF) as is discussed above with reference to FIGS. 2 through 5. It is understood that the flow diagram shown in FIG. 7 is intended to be illustrative only, and is not intended to be limiting with regard to the manner in which the estimated power requirement can be determined in accordance with one or more of the various embodiments of the present invention.

Furthermore, it is understood that the general process depicted in the flow diagram of FIG. 7 can be accomplished by the set of computer executable instructions 160 which are discussed above with reference to FIG. 1. That is, it is understood that the set of computer executable instructions 160 can be adapted to determine the estimated power requirement as a function of one or more input parameters in accordance with any number of possible manners, including that discussed above with reference to FIG. 7.

It can then be appreciated that the set of computer executable instructions 160 can be adapted to control the operation of the heater 113. More specifically, for example, the set of computer executable instructions 160 can be adapted to control the operation of the heater 113 by determining and/or specifying the heater-on period HP and/or the heater-on frequency (inverse of length HF) as in the manner discussed above with reference to FIGS. 2 through 5.

Figure 8:
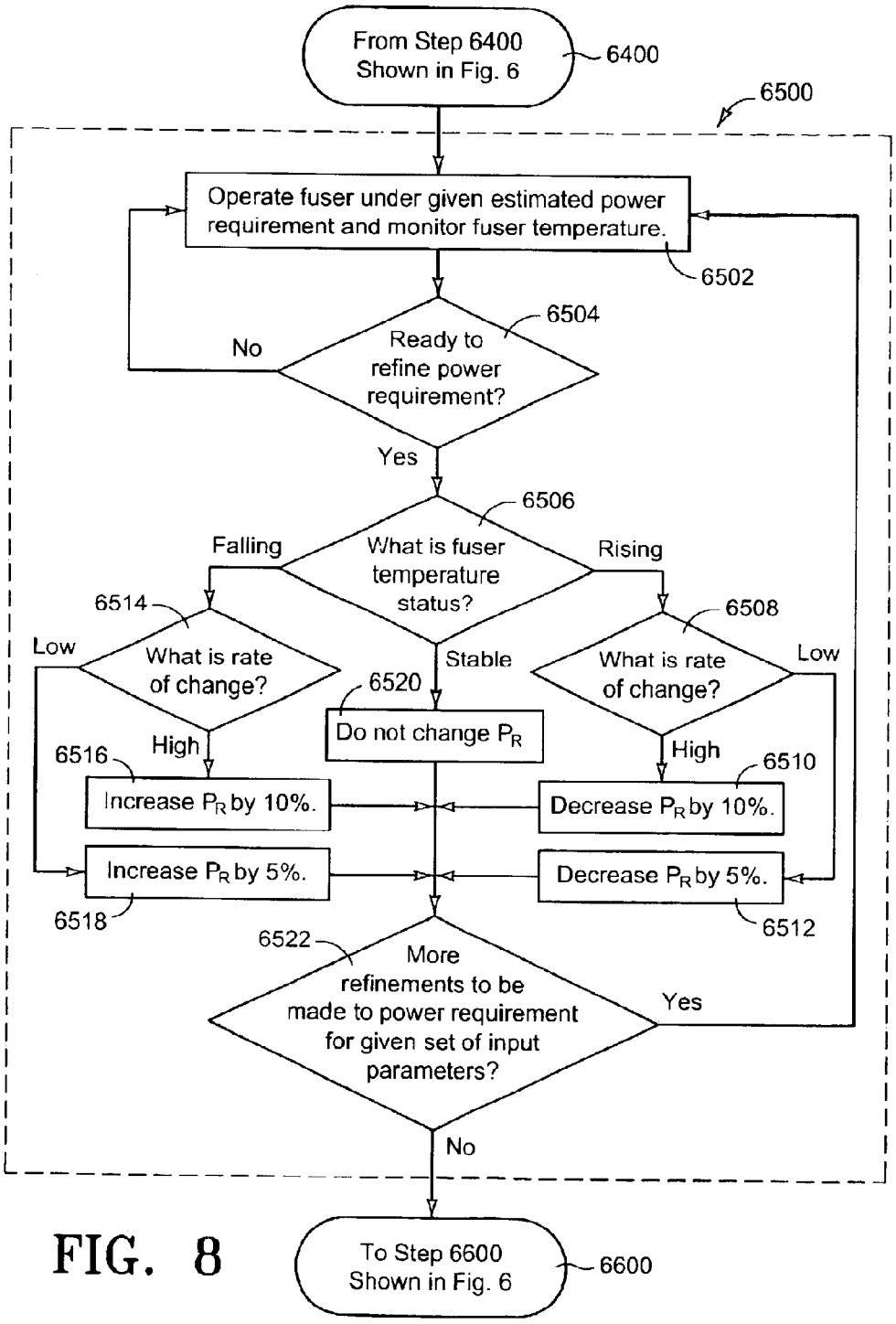
FIG. 8 is another flow diagram that depicts one example of a detailed view of step 6500 of the flow diagram shown in FIG. 6.

Turning now to FIG. 8, yet another flow diagram is shown which depicts one possible example of a process that can be employed to accomplish at least a portion of step 6500 that is discussed above with reference to FIG. 6. That is, the flow diagram shown in FIG. 8 can be described as depicting one possible version of a detailed view of step 6500 in accordance with which the fuser 110 and/or the heater 113 are operated, and in accordance with which the fuser temperature is monitored and the heater-on period (HP, shown in FIGS. 2 through 5) and/or heater-on frequency (inverse of length HF, also shown in FIGS. 2 through 5) are refined accordingly.

With reference to FIG. 8, from step 6400, the flow diagram proceeds to the next step which is that of step 6502. In accordance with step 6502, the fuser 110 and/or heater 113 are operated in accordance with the estimated power requirement that can be determined as described above with reference to FIG. 7. Also, as is seen from a study of FIG. 8, the fuser temperature is monitored in accordance with step 6502.

Proceeding from step 6502, step 6504 is the next step of the flow diagram shown in FIG. 8. Step 6504 is a query that asks if the power requirement should be refined or adjusted. The answer to the query of step 6504 can depend on any of a number of various factors. For example, the answer to the query of step 6504 can depend upon whether a given time period has elapsed. That is, for example, the power requirement can be analyzed after the expiration of a given period of time. Alternatively, the answer to the query of step 6504 can depend upon whether a given number of sheets of media have been fused, or whether a given number of images have been fused.

In any case, if the answer to the query of step 6504 is "no," then the flow diagram of FIG. 8 is directed back to step

6502. However, if the answer to the query of step 6504 is "yes," then the flow diagram of FIG. 8 proceeds to step 6506, which is another query. The query of step 6506 asks about the status of the fuser temperature. More specifically, the query of step 6506 asks if the fuser temperature is either falling, rising, or whether it is stable.

It can be appreciated that it is generally beneficial to operate the fuser at a temperature that is not only sufficient to accomplish the fusing process, but which is also substantially stable. That is, a stable fuser temperature can be beneficial with regard to reducing the effects of the gloss band phenomenon discussed above. If the fuser temperature is detected to be substantially stable in accordance with step 6506, then the flow diagram of FIG. 8 proceeds to step 6520. In accordance with step 6520, the power requirement does not change.

However, if the answer to the query of step 6506 is that the fuser temperature is falling, then the flow diagram of FIG. 8 proceeds to step 6514. Step 6514 is another query that asks whether the fuser temperature is falling at a low rate or at a high rate. If the fuser temperature is falling at a low rate, then the flow diagram proceeds to step 6518 in accordance with which the power requirement is increased, for example, by five percent. If the fuser temperature is found at step 6514 to be falling at a high rate, then the flow diagram is directed to step 6516 in accordance with which the power requirement is increased, for example, by ten percent.

On the other hand, if the answer to the query of step 6506 is that the fuser temperature is rising, then the flow diagram of FIG. 8 proceeds to step 6508. Step 6506 is yet another query that asks if the fuser temperature is rising at a low rate or at a high rate. If the answer to the query of step 6508 is that the fuser temperature is rising at a low rate, then the flow diagram of FIG. 8 is directed to step 6512 in accordance with which the power requirement is decreased, for example, by five percent. But, if the answer to the query of step 6508 is that the fuser temperature is rising at a high rate, then the flow diagram proceeds to step 6510 in accordance with which the power requirement is decreased by, for example, ten percent.

As is seen from an examination of FIG. 8, that the flow diagram shown therein ends up at step 6522, regardless of the answer to the query of step 6506. Step 6522 is still another query that asks if more refinements to the power requirement are to be made. The answer to the query of step 6522 can depend upon any of a number of various factors.

For example, if only a relatively low amount of fusing remains to be accomplished on the print job at hand, then the answer to the query of step 6522 can be "no," in which case the flow diagram proceeds to step 6600 which is also shown in FIG. 6. Alternatively, for example, if the amount of fusing remaining to be accomplished is relatively high, then the answer to the query of step 6522 can be "yes," in which case the flow diagram returns to step 6502.

It is understood that the process depicted by the flow diagram of FIG. 8 is intended only as an illustrative example of such a process and is not intended to be limiting in regard other specific examples of the process. Furthermore, it is understood that the set of computer executable instructions 160 can be adapted to perform the process depicted in FIG. 8 in conjunction with the processor 150, as well as the temperature detector 140.

It will be appreciated that the flowcharts depicted in FIGS. 6 through 8 are exemplary only, and can include additional, fewer, different or modified steps, all in accordance with the present invention.

In accordance with another embodiment of the present invention, a method of operating an imaging fuser to fuse an imaging substance onto an imaging media includes defining a heater-on period. That is, defining a heater-on period can include, for example, defining a fixed heater-on period, or otherwise predetermining the heater-on period. The heater-on period is discussed in detail above.

The method can be accomplished in conjunction with an apparatus such as the apparatus 100 described above with reference to FIG. 1. That is, the method can be employed to operate an apparatus such as the fusing apparatus 100, which can include a heater such as the heater 113 described above also with reference to FIG. 1.

The method can also include defining an initial image area on the image media. An "image area" is any area that can be defined on one or more sheets of imaging media such that, within such image area, at least a portion of an image is to be fused in accordance with the method. Thus, an initial image area is an image area that is defined initially.

The method can also include ascertaining one or more initial input parameters corresponding to the initial image area. Such input parameters can be ascertained, for example, by detection and/or measurement by way of input sensors such as the input sensors 152 described above with reference to FIG. 1. Furthermore, the nature of input parameters is also discussed in detail above.

That is, an input parameter can be a relative value that represents any variable condition or measurement that can be ascertained, and upon which value an estimated power requirement of the fusing device for fusing of an image area can depend. For example, an input parameter can be imaging media caliper, image density, ambient relative humidity, ambient temperature, imaging media moisture content, or fusing temperature as is discussed above.

The method can also include determining a heater-on frequency as a function of the one or more initial input parameters. That is, the heater-on frequency can be determined based on, and/or in response to, one or more of the input parameters as is discussed above in detail with reference to FIGS. 2 through 5. That is, as is discussed above with reference to FIGS. 2 through 5, the length HF, which represents the inverse of the heater-on frequency, can be determined in accordance with the method as a function of at least one input parameter which can be ascertained by way of an associated input sensor such as the input sensor 152 which is described above with reference to FIG. 1.

Furthermore, determining the heater-on frequency can be accomplished by way of a set of computer executable instructions along with a processor and memory device such as the set of computer executable instructions 160, the processor 150, and the memory device 154 which are each described above with particular reference to FIG. 1. It is understood that determining the heater-on frequency can be performed as a function of a predetermined and/or fixed heater-on period, as is also mentioned in the discussion above.

Also in accordance with the method, once the heater-on frequency is determined, the heater and/or fuser can be operated to fuse the initial imaging area, wherein the heater is on only during each of a plurality of heater-on periods, and wherein the heater-on periods occur at the heater-on frequency. That is, the heater and/or the fuser can be operated in accordance with the method, wherein the heater is turned on a plurality of times at the heater-on frequency, and wherein the heater remains on for the heater-on period each time it is turned on, and wherein the initial image area is fused by way of such operation of the heater and/or the fuser. An operational scheme that is similar to the method is discussed above with reference to FIGS. 6 and 7.

The method can also include detecting a fuser temperature and adjusting, or refining, the heater-on frequency as a function of the fuser temperature. The detecting of the fuser temperature can be accomplished by way of a temperature sensor such as the temperature sensor 140 that is shown in FIG. 1 and which is discussed above with reference thereto. An operational scheme for adjusting the heater-on frequency as a function of the fuser temperature is discussed above with reference to FIG. 8.

More specifically, for example, the detecting of the fuser temperature in accordance with the method can include detecting a high fuser temperature. That is, when the fuser temperature is detected and measured, the fuser temperature can be analyzed to determine its nature. One possible result of such an analysis is that the fuser temperature can be determined to be high. In that case, the adjusting of the fuser temperature can include decreasing the heater-on frequency in response to detecting the high fuser temperature.

Alternatively, the detecting of the fuser temperature can include detecting a low fuser temperature. That is, when the fuser temperature is detected and measured, the temperature can be determined to be low as a result of an analysis thereof. In that case, the adjusting of the heater-on frequency can include increasing the heater-on frequency in response to detecting a low fuser temperature.

That is, decreasing the heater-on frequency can result in a decrease of the fuser temperature for a given heater-on period. Similarly, increasing the heater-on frequency can result in an increase of the fuser temperature for a given heater-on period. As is discussed above, this process of adjusting the heater-on frequency, as well as that of adjusting the heater-on period, can also be described as refining the heater-on frequency and heater-on period, respectively.

The method can further include providing a memory device such as, for example, the memory device 154 that is shown in FIG. 1 and that is discussed above with reference thereto. An act or step of storing the adjusted heater-on frequency and the associated one or more initial input parameters in the memory device can also be included in the method. That is, the method can include causing the memory device to store therein data representative of the heater-on period as well as the associated initial input parameters for later recall.

In such a case, the method can include defining a subsequent image area on the image media. A "subsequent image area" is similar to the initial image area described above with regard to the method, except that the subsequent image area is an image area that is defined after the initial image area is defined. Thus, once the subsequent image area is defined in the image media, one or more subsequent input parameters corresponding to the subsequent image area can be ascertained. That is, as the initial input parameters correspond to the initial image area as discussed above, the subsequent input parameters likewise correspond to the subsequent image area.

The method can additionally include determining that the subsequent input parameters are substantially similar to the initial input parameters. That is, once the subsequent input parameters are ascertained, the memory device can be searched to determine if any previously ascertained input parameters are substantially similar to the subsequent input parameters.

Thus, if the initial input parameters are substantially similar to the subsequent input parameters, and if the initial input parameters have been stored for later recall as described above, then a determination can be made that the subsequent input parameters are substantially similar to the initial input parameters. Such an act or step can be accomplished by the set of computer executable instructions 160, along with the processor 150 and memory device 154, for example.

Moreover, in accordance with the method, if the determination is made that the subsequent input parameters are substantially similar to the initial input parameters, then the adjusted heater-on frequency can be recalled from the memory device in response to determining that the subsequent input parameters are substantially similar to the one or more initial input parameters.

That is, if the determination is made that the subsequent input parameters are substantially similar to the initial input parameters, then the adjusted heater-on frequency to which the initial input parameters correspond, and which has been stored in the memory device, can be recalled. In such a case, the heater and/or the fuser can be operated at the recalled adjusted heater-on frequency to fuse the subsequent image area.

Furthermore, for example, the heater and/or the fuser can be operated at the recalled adjusted heater-on frequency and at the predetermined heater-on period to fuse the subsequent image area. The operation of the heater and/or fuser at the recalled heater-on frequency and/or at the recalled heater-on period can result in a more accurate fuser temperature for the associated input parameters, and thus, can result in an initially more stable fuser temperature.

It is understood, as is explained above, that the initial input parameters and/or the subsequent input parameters can be any of a number of specific input parameters such as image density, imaging media caliper (thickness), imaging media moisture content, ambient temperature, and ambient relative humidity among others.

The method can further include detecting a solid fill image in the initial image area and/or in the subsequent image area, wherein operation of the fuser and/or heater to fuse the initial image area and/or to fuser the subsequent image area includes preventing the heater from either turning on or turning off while fusing the solid fill image.

A "solid fill image" is defined as an image or portion thereof that is substantially solid with regard to the coverage of the imaging media by an imaging substance to form the respective portions of the image. Thus, the method can include preventing the heater from either turning on or turning off while fusing a solid fill image.

In accordance with the method, the heater-on frequency can be determined by defining a maximum power capacity of the heater. That is, for example, the heater can be rated at a maximum power capacity. Alternatively, the maximum power capacity can be defined as any reference power capacity of power level of the heater.

An estimated power requirement for fusing the initial image area can be estimated based on the corresponding initial input parameters. These acts or steps can be substantially similar to the operational scheme for estimating the heater power requirement discussed above with reference to FIG. 7. A corresponding heater-on frequency can then be determined by dividing estimated power requirement by the product of the maximum power capacity of the heater and the heater-on period.

In accordance with yet another embodiment of the present invention, a method of operating an image fuser to fuse an imaging substance onto an imaging media, wherein the fuser includes a heater, can be substantially similar to the method described immediately above except that, rather than defining the heater-on period and then determining the heater-on frequency as a function of one or more input parameters, the method includes defining a heater-on frequency and then determining a heater-on period as a function of one or more input parameters.

That is, the method includes defining the heater-on frequency and defining an initial image area on the imaging media. In other words, in accordance with this method, the heater-on frequency can be fixed, while the heater-on period can be variable. The method further includes ascertaining one or more initial input parameters corresponding to the initial image area are ascertained.

The heater-on period is then determined as a function of the one or more initial input parameters, and the heater and/or the fuser can be operated to fuse the initial image area, wherein the heater is on only during each of a plurality of heater-on periods, and wherein the heater-on periods occur at the heater-on frequency. The method can also include detecting a fuser temperature and adjusting the heater-on period as a function of the fuser temperature in a manner similar to that of the previously described method.

Furthermore, the detecting of the fuser temperature can include detecting a high fuser temperature or detecting a low fuser temperature. In the case of detecting a high fuser temperature, the adjusting of the heater-on period can include decreasing the heater-on period in response to detecting the high fuser temperature.

Alternatively, if a low fuser temperature is detected, then the adjusting of the heater-on period can include increasing the heater-on period in response to detecting the low fuser temperature. Such steps or acts can be accomplished, for example, by way of the temperature sensor 140 described above with reference to FIG. 1.

The method can further include providing a memory device, as well as storing the adjusted heater-on period in the memory device along with the associated one or more initial input parameters. A subsequent image area can be defined on the imaging media and one or more subsequent input parameters can be ascertained, wherein the subsequent input parameters correspond to the subsequent image area.

As is discussed above, the subsequent input parameters can be analyzed to determine whether they are substantially similar to the initial input parameters stored in the memory device. If the determination is made that the subsequent input parameters are substantially similar to the initial input parameters, then the adjusted heater-on period can be recalled from the memory device in response to such a determination. The heater and/or the fuser can then be operated at the adjusted heater-on period and the predefined heater-on frequency to fuse the subsequent image area.

The determining of the heater-on period can include defining a maximum power capacity of the image fuser and estimating a power requirement for the initial image area based on the one or more initial input parameters. The heater-on period can then be estimated by dividing the estimated power requirement by the product of the heater-on frequency and the maximum power capacity. The method can also include detecting a solid fill image in the initial image area, wherein operating the heater to fuse the initial image area includes preventing the heater from either turning on or turning off during fusing of the solid fill image.

Further acts and steps of the method can include defining a maximum power capacity of the image fuser, and estimating a power requirement for the initial imaging area based on one or more initial input parameters. As is mentioned above, the maximum power capacity of the heater can be defined as any reference power level of the heater, including the maximum rated power capacity of the heater. An additional act or step of the method can be to divide the power requirement by the product of the heater-on frequency and the maximum power capacity to determine the heater-on period.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of operating an imaging fuser to thermally fuse an imaging substance onto an imaging media, wherein the fuser includes a heater, the method comprising:

defining a heater-on period:

defining an initial image area on the imaging media;

ascertaining one or more initial input parameters corresponding to the initial image area;

determining a heater-on frequency as a function of the one or more of the initial input parameters; and, operating the heater to fuse the initial imaging area, wherein the heater is on only during each of a plurality of heater-on periods, and wherein the heater-on periods occur at the heater-on frequency.

2. The method of claim 1, and further comprising:

detecting a fuser temperature; and, adjusting the heater-on frequency as a function of the fuser temperature.

3. The method of claim 2, and wherein:

detecting the fuser temperature comprises detecting a high fuser temperature; and, adjusting the heater-on frequency comprises decreasing the heater-on frequency in response to detecting the high fuser temperature.

4. The method of claim 2, and wherein:

detecting the fuser temperature comprises detecting a low fuser temperature; and, adjusting the heater-on frequency comprises increasing the heater-on frequency in response to detecting the low fuser temperature.

5. The method of claim 2, and further comprising:

providing a memory device;

storing the adjusted heater-on frequency and the associated one or more initial input parameters in the memory device;

defining a subsequent image area on the imaging media;

ascertaining one or more subsequent input parameters corresponding to the subsequent image area;

determining that the subsequent input parameters are substantially similar to the initial input parameters;

recalling the adjust heater-on frequency from the memory device in response to determining that the subsequent input parameters are substantially similar to the one or more initial input parameters; and, operating the heater at the adjusted heater-on frequency and the heater-on period to fuse the subsequent image area.

6. The method of claim 1, and wherein the one or more initial input parameters are selected from the group consisting of image density, imaging media caliper, ambient relative humidity, ambient temperature, and imaging media moisture content.

7. The method of claim 1, and further comprising detecting a solid fill image in the initial image area, and wherein operating the heater to fuse the initial image area comprises preventing the heater from either turning on or turning off while fusing the solid fill image.

8. The method of claim 1, and wherein determining the heater-on frequency comprises:

defining a maximum power capacity of the image fuser;

estimating a power requirement for the initial imaging area based on the one or more initial input parameters; and, dividing the power requirement by the product of the maximum power capacity and the heater-on period.

9. A method of operating an imaging fuser to thermally fuse an imaging substance onto an imaging media, wherein the fuser includes a heater, the method comprising:

defining a heater-on frequency:

defining an initial image area on the imaging media;

ascertaining one or more initial input parameters corresponding to the initial imaging area;

determining a heater-on period as a function of the one or more initial input parameters; and, operating the heater to fuse the initial imaging area, wherein the heater is on only during each of a plurality of heater-on periods, and wherein the heater-on periods occur at the heater-on frequency.

10. The method of claim 9, and further comprising:

detecting a fuser temperature; and, adjusting the heater-on period as a function of the fuser temperature.

11. The method of claim 10, and wherein:

detecting a fuser temperature comprises detecting a high fuser temperature; and, adjusting the heater-on period comprises decreasing the heater-on period in response to detecting the high fuser temperature.

12. The method of claim 10, and wherein:

detecting the fuser temperature comprises detecting a low fuser temperature; and, adjusting the heater-on period comprises increasing the fuser-on frequency in response to detecting the low fuser temperature.

13. The method of claim 10, and further comprising:

providing a memory device;

storing the adjusted heater-on period and the associated one or more initial input parameters in the memory device;

defining a subsequent image area on the imaging media;

ascertaining one or more subsequent input parameters corresponding to the subsequent image area;

determining that the subsequent one or more input parameters are substantially similar to the one or more initial input parameters;

recalling the adjusted heater-on period from the memory device in response to determining that the one or more subsequent input parameters are substantially similar to the one or more initial input parameters; and, operating the heater at the adjusted heater-on period and heater-on frequency to fuse the subsequent image area.

14. The method of claim 9, and wherein the one or more initial input parameters are selected from the group consisting of image density, imaging media caliper, ambient relative humidity, ambient temperature, and imaging media moisture content.

15. The method of claim 9, and further comprising detecting a solid fill image in the initial image area, and wherein operating the heater to fuse the initial image area comprises preventing the heater from either turning on or turning off while fusing the solid fill image.

16. The method of claim 9, and wherein determining the heater-on period comprises:

defining a maximum power capacity of the image fuser;

estimating a power requirement for the initial imaging area based on the one or more initial input parameters; and, dividing the power requirement by the product of the heater-on frequency and the maximum power capacity.

17. A fusing apparatus configured to thermally fuse an imaging substance onto to an imaging media, the apparatus comprising:

a heater;

a processor adapted to transmit a plurality of alternating first control signals and second control signals;

a computer-readable memory device;

a controller in data-communicative linkage with the processor and adapted to control the heater by alternately turning the heater on in response to each first control signal and turning the heater off in response to each second control signal;

a sensor in data-communicative linkage with the processor and adapted to:

detect an input parameter; and, transmit a data signal to the processor, wherein the data signal is indicative of the input parameter; and, a set of computer executable instructions resident within the computer-readable memory device and operatively executable by the processor and adapted to cause transmission of the plurality of alternating first control signals and second control signals, wherein:

the first control signals are transmitted at a given frequency; and, transmission of each second control signal follows transmission of a respective first control signal by a heater-on period that is determined by the set of computer executable instructions as a function of the input parameter.

18. The apparatus of claim 17, and further comprising an imaging section adapted to deposit the imaging substance onto the imaging media.

19. The apparatus of claim 17, and further comprising a fuser temperature sensor in data-communicative linkage with the processor and adapted to:

detect the temperature of at least a portion of the fuser;

generate a fuser temperature data signal in response thereto; and, transmit the fuser temperature data signal to the processor.

20. The apparatus of claim 19, and wherein:

the processor is configured to receive the fuser temperature data signal from the fuser temperature sensor; and, the set of computer executable instructions is further adapted to adjust the heater-on period as a function of the fuser temperature data signal received by the processor.

21. The apparatus of claim 20, and wherein the set of computer executable instructions is further adapted to:

determine whether the fuser temperature is high or low; and, adjust the heater-on period by decreasing the heater-on period in response to determining that the fuser temperature is high, and increasing the heater-on period in response to determining that the fuser temperature is low.

22. A fusing apparatus configured to thermally fuse an imaging substance onto an imaging media, the apparatus comprising:

a heater;

a processor adapted to transmit a plurality of alternating first control signals and second control signals;

computer-readable memory device;

a controller in data-communicative linkage with the processor and adapted to control the heater by alternately turning the heater on in response to each first control signal and turning the heater off in response to each second control signal;

a sensor in data-communicative linkage with the processor and adapted to:

detect an input parameter; and, transmit a data signal to the processor, wherein the data signal is indicative of the input parameter; and, a set of computer executable instructions resident within the computer-readable memory device and operatively executable by the processor and adapted to cause transmission of the plurality of alternating first control signals and second control signals, wherein:

the first control signals are transmitted at a heater-on frequency that is determined by the set of computer executable instructions as a function of the environmental data; and, each second control signal is transmitted after a respective heater-on period which follows the transmission of each respective first control signal.

23. The apparatus of claim 22, and further comprising an imaging section adapted to deposit the imaging substance onto the imaging media.

24. The apparatus of claim 22, and further comprising a fuser temperature sensor in data-communicative linkage with the processor and adapted to:

detect the temperature of at least a portion of the fuser;

generate a fuser temperature data signal in response thereto; and, transmit the fuser temperature data signal to the processor.

25. The apparatus of claim 24, and wherein:

the processor is configured to receive the fuser temperature data signal from the fuser temperature sensor; and, the set of computer executable instructions is further adapted to adjust the heater-on frequency as a function of the fuser temperature data signal received by the processor.

26. The apparatus of claim 25, and wherein the set of computer executable instructions is further adapted to determine whether the fuser temperature is high or low; and, adjust the heater-on frequency by increasing the heater-on frequency in response to determining that the fuser temperature is high and decreasing the heater-on frequency in response to determining that the fuser temperature is low.

27. An imaging apparatus configured to deposit an imaging substance onto an imaging media to form an image, the apparatus comprising:

a fuser that includes a heater, wherein the fuser is adapted to thermally fuse the imaging substance onto the imaging media;

a processor adapted to transmit a plurality of alternating first control signals and second control signals;

computer-readable memory device a controller in data-communicative linkage with the processor and adapted to control the heater by alternately turning the heater on in response to each first control signal and turning the heater off in response to each second control signal;

a sensor in data-communicative linkage with the processor and adapted to:

detect an input parameter; and, transmit a data signal to the processor, wherein the data signal is indicative of the input parameter; and, a set of computer executable instructions resident within the computer-readable memory device and operatively executable by the processor and adapted to cause transmission of the plurality of alternating first control signals and second control signals, wherein:

the first control signals are transmitted at a heater-on frequency; and, each second control signal is transmitted at the end of a respective heater-on period that commences at the transmission of a respective first control signal, wherein at least the heater-on frequency or the heater-on period is determined by the set of computer executable instructions as a function of the environmental data.

28. A method of operating an imaging fuser to thermally fuse an imaging substance onto an imaging media, wherein the fuser includes a heater, the method comprising:

defining an initial image area on the imaging media;

ascertaining one or more initial input parameters corresponding to the initial image area;

determining either a heater-on period or a heater-on frequency as a function of the one or more initial input parameters; and, operating the heater to fuse the initial imaging area, wherein the heater is on only during each of a plurality of the heater-on periods, and wherein the heater-on periods occur at the heater-on frequency.

29. An apparatus for thermally fusing an imaging substance onto an imaging media, the apparatus comprising:

a heating means for producing heat energy for fusing the imaging substance onto the imaging media;

a means for ascertaining one or more input parameters; and, a means for turning the heating means on and off, wherein:

the heating means is configured to be turned on a plurality of times at a predetermined heater-on frequency; and, the heating means is configured to remain on for an associated heater-on period each time it is turned on, the duration of which heater-on period is a function of the one or more input parameters.

30. An apparatus for thermally fusing an imaging substance onto an imaging media, the apparatus comprising:

a heating means for producing heat energy for fusing the imaging substance onto the imaging media;

a means for ascertaining one or more input parameters; and, a means for turning the heater on and off, wherein:

the heating means is configured to be turned on a plurality of times, wherein each time the heating means is turned on, it remains on for a predetermined heater-on period; and, the heating means is configured to be turned on at a heater-on frequency that is a function of the one or more input parameters.

* * * * *